US012604932B2

(12) United States Patent
Chen

(10) Patent No.: US 12,604,932 B2
(45) Date of Patent: Apr. 21, 2026

(54) AEROSOL PROVISION SYSTEM

(71) Applicant: NICOVENTURES TRADING LIMITED, London (GB)

(72) Inventor: Shixiang Chen, London (GB)

(73) Assignee: NICOVENTURES TRADING LIMITED, London (GB)

( * ) Notice: Subject to any disclaimer, the term of this patent is extended or adjusted under 35 U.S.C. 154(b) by 798 days.

(21) Appl. No.: 17/756,530

(22) PCT Filed: Nov. 16, 2020

(86) PCT No.: PCT/GB2020/052915
§ 371 (c)(1),
(2) Date: May 26, 2022

(87) PCT Pub. No.: WO2021/105649
PCT Pub. Date: Jun. 3, 2021

(65) Prior Publication Data

US 2022/0408835 A1 Dec. 29, 2022

(30) Foreign Application Priority Data

Nov. 29, 2019 (GB) ..... 1917442

(51) Int. Cl.
*A24F 40/51* (2020.01)
*A24F 40/40* (2020.01)

(52) U.S. Cl.
CPC ..... *A24F 40/51* (2020.01); *A24F 40/40* (2020.01)

(58) Field of Classification Search
CPC ..... A24F 40/51
See application file for complete search history.

(56) References Cited

U.S. PATENT DOCUMENTS

2014/0014126 A1* 1/2014 Peleg ..... A24F 40/10 374/54
2014/0299141 A1 10/2014 Flick
(Continued)

FOREIGN PATENT DOCUMENTS

CA 3096955 A1 9/2019
EP 2672848 A2 12/2013
(Continued)

OTHER PUBLICATIONS

International Preliminary Report on Patentability for Application No. PCT/GB2020/052915, mailed on Apr. 5, 2022, 7 pages.
(Continued)

*Primary Examiner* — Cynthia Szewczyk
(74) *Attorney, Agent, or Firm* — MERCHANT & GOULD P.C.

(57) ABSTRACT

An aerosol provision system having a heating system; a power system for providing power to the heating system; and control circuitry for controlling a heating profile provided by the heating system, the control circuitry including a first sensor for measuring an output of the power system; and a second sensor for measuring an electrical property of the heating system, wherein the control circuitry controls the heating profile provided by the heating system based on measurements from the first sensor and the second sensor, and wherein the first sensor and second sensor are arranged to take measurements during periods of non-smoking.

17 Claims, 3 Drawing Sheets

(56) References Cited

U.S. PATENT DOCUMENTS

| | | | | |
|---|---|---|---|---|
| 2014/0338685 | A1 | 11/2014 | Amir | |
| 2014/0345635 | A1 | 11/2014 | Rabinowitz et al. | |
| 2015/0237916 | A1 | 8/2015 | Farine et al. | |
| 2016/0213066 | A1 | 7/2016 | Zitzke et al. | |
| 2016/0219938 | A1 | 8/2016 | Mamoun et al. | |
| 2018/0042306 | A1* | 2/2018 | Atkins | A24F 40/50 |

FOREIGN PATENT DOCUMENTS

| | | | |
|---|---|---|---|
| EP | 2770859 | A1 | 9/2014 |
| EP | 2895930 | B1 | 11/2016 |
| EP | 3092909 | A1 | 11/2016 |
| EP | 3141135 | A1 | 3/2017 |
| EP | 3151690 | A1 | 4/2017 |
| EP | 2967140 | B1 | 5/2017 |
| EP | 3182847 | A1 | 6/2017 |
| EP | 3235390 | A1 | 10/2017 |
| EP | 3236787 | A1 | 11/2017 |
| EP | 3295814 | A2 | 3/2018 |
| EP | 2856893 | B1 | 6/2018 |
| EP | 3341995 | A1 | 7/2018 |
| EP | 3365051 | A1 | 8/2018 |
| EP | 3100623 | B1 | 12/2018 |
| EP | 3496557 | A1 | 6/2019 |
| EP | 3524071 | A1 | 8/2019 |
| GB | 2543906 | A | 5/2017 |
| GB | 2569522 | A | 6/2019 |
| TW | 201625149 | A | 7/2016 |
| WO | 2013060781 | A1 | 5/2013 |
| WO | 2014040988 | A2 | 3/2014 |
| WO | 2016210242 | A1 | 12/2016 |
| WO | 2018019533 | A1 | 2/2018 |
| WO | 2018163262 | A1 | 9/2018 |
| WO | 2018166925 | A1 | 9/2018 |
| WO | 2018182322 | A1 | 10/2018 |
| WO | 2018185460 | A1 | 10/2018 |
| WO | 2018188469 | A1 | 10/2018 |
| WO | 2018202403 | A1 | 11/2018 |
| WO | 2019003166 | A1 | 1/2019 |
| WO | 2019006991 | A1 | 1/2019 |
| WO | 2019037583 | A1 | 2/2019 |
| WO | 2019066228 | A1 | 4/2019 |
| WO | 2019068821 | A1 | 4/2019 |
| WO | 2019077708 | A1 | 4/2019 |
| WO | 2019082248 | A1 | 5/2019 |
| WO | 2019082282 | A1 | 5/2019 |
| WO | 2019122880 | A1 | 6/2019 |
| WO | WO-2019115464 | A1 | 6/2019 |
| WO | WO-2019141577 | A1 | 7/2019 |
| WO | 2019148049 | A1 | 8/2019 |
| WO | 2019153012 | A1 | 8/2019 |
| WO | 2020213917 | A2 | 10/2020 |

OTHER PUBLICATIONS

International Search Report and Written Opinion for Application No. PCT/GB2020/052915, mailed on Feb. 19, 2021, 16 pages.

"Notice of Opposition received for European Application No. 20811080.9, mailed on Jun. 11, 2024", 42 pages.

* cited by examiner

AEROSOL PROVISION SYSTEM

PRIORITY CLAIM

The present application is a National Phase entry of PCT Application No. PCT/GB2020/052915, filed Nov. 16, 2020, which claims priority from GB Patent Application No. 1917442.4, filed Nov. 29, 2019, both of which are hereby fully incorporated herein by reference.

TECHNICAL FIELD

The present invention relates to an aerosol provision system, a method of providing an aerosol, control circuitry for an aerosol provision system and aerosol provision means.

BACKGROUND

Aerosol provision systems (also known as aerosol provision devices) are known. Common systems use heaters to create an aerosol from an aerosol generating medium which is then inhaled by a user. Modern systems have control circuitry to control the heating profile provided to heaters. Suitable heating conditions for producing aerosols from an aerosol generating medium may vary based on the medium in the system, the amount of medium in the system and electrical conditions within the system.

It is desirable for aerosol provision devices to provide heating profiles which are suitable for the aerosol generating medium present in the device during use. Therefore it is advantageous to provide an improved system to provide improved heating profiles.

The present invention is directed toward solving some of the above problems.

SUMMARY

Aspects of the invention are defined in the accompanying claims.

In accordance with some embodiments described herein, there is provided an aerosol provision system comprising: a heating system; a power system for providing power to the heating system; and, control circuitry for controlling a heating profile provided by the heating system, the control circuitry comprising: a first sensor, for measuring an output of the power system; and, a second sensor, for measuring an electrical property of the heating system, wherein the control circuitry controls the heating profile provided by the heating system based on measurements from the first sensor and the second sensor, and wherein the first sensor and second sensor are arranged to take measurements during periods of non-smoking.

In accordance with some embodiments described herein, there is provided a method of providing an aerosol in an aerosol provision device, the method comprising: providing a heating system; providing a power system for providing power to the heating system; providing control circuitry for controlling a heating profile provided by the heating system; providing a first heating profile for a first puff; measuring at least one of an output of the power system and an electrical property of the heating system after the first puff; and, providing a second heating profile for a second puff.

In accordance with some embodiments described herein, there is provided control circuitry for an aerosol provision system comprising: a first sensor, for measuring an output of a power system of the aerosol provision system; and, a second sensor, for measuring an electrical property of a heating system of the aerosol provision system, wherein the control circuitry controls a heating profile provided by the heating system based on measurements from the first sensor and the second sensor, and wherein the first sensor and second sensor are arranged to take measurements during periods of non-use of the aerosol provision system.

In accordance with some embodiments described herein, there is provided aerosol provision means comprising: heating means; power means for providing power to the heating means; and, control means for controlling a heating profile provided by the heating means, the control means comprising: first sensing means, for measuring an output of the power means; and, second sensing means, for measuring an electrical property of the heating means, wherein the control means controls the heating profile provided by the heating means based on measurements from the first sensing means and the second sensing means, and wherein the first sensing means and second sensing means are arranged to take measurements during periods of non-smoking.

DESCRIPTION OF DRAWINGS

The present teachings will now be described by way of example only with reference to the following figure.

Figure 1:
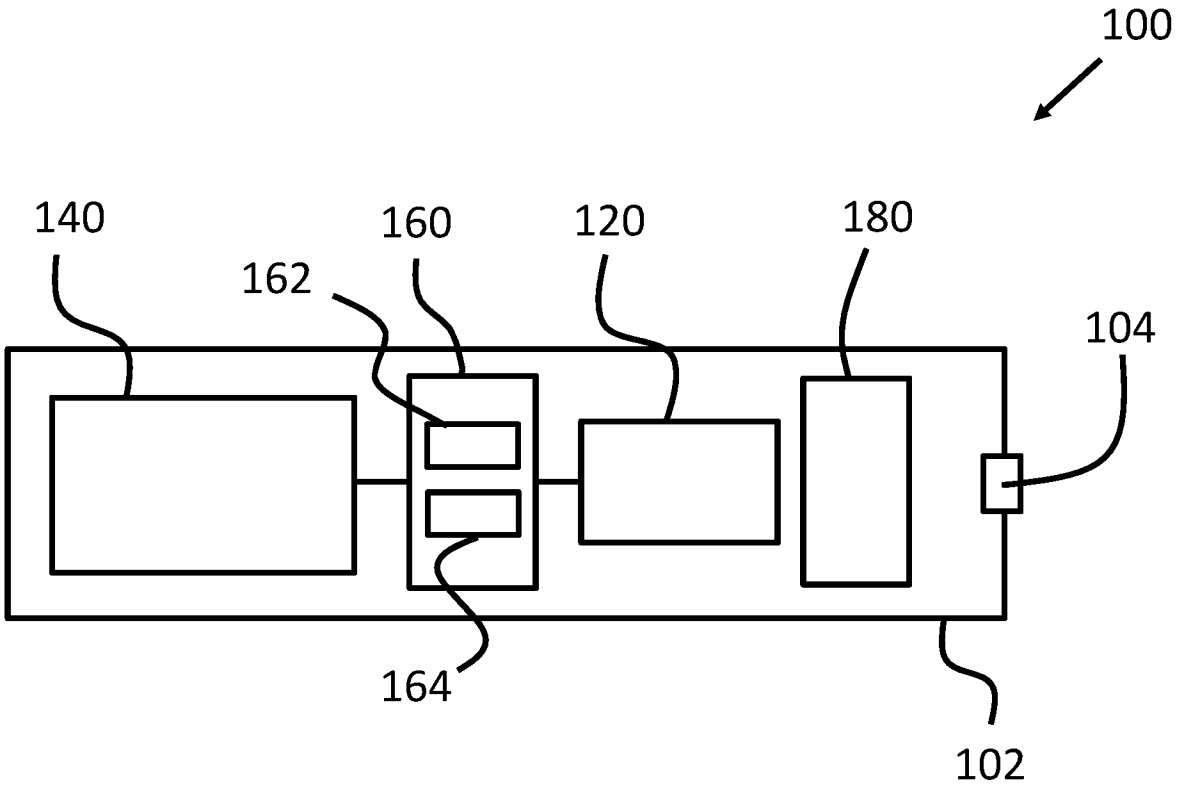
FIG. 1 is a longitudinal cross-sectional view of an aerosol provision system according to an example.

While the invention is susceptible to various modifications and alternative forms, specific embodiments are shown by way of example in the drawings and are herein described in detail. It should be understood, however, that the drawings and detailed description of the specific embodiments are not intended to limit the invention to the particular forms disclosed. On the contrary, the invention covers all modifications, equivalents and alternatives falling within the scope of the present invention as defined by the appended claims.

DETAILED DESCRIPTION

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to aerosol provision systems, which may also be referred to as aerosol provision systems, such as e-cigarettes. Throughout the following description the term "e-cigarette" or "electronic cigarette" may sometimes be used, but it will be appreciated this term may be used interchangeably with aerosol provision system/device and electronic aerosol provision system/device. Furthermore, and as is common in the technical field, the terms "aerosol" and "vapor", and related terms such as "vaporize", "volatilize" and "aerosolize", may generally be used interchangeably.

As shown in the example of FIG. 1, an aerosol provision system 100 is disclosed which comprises a heating system 120. The aerosol provision system 100 has a power system 140 for providing power to the heating system 120. The aerosol provision system 100 has control circuitry 160 for controlling a heating profile provided by the heating system 120. The control circuitry 160 has a sensor 162 for measuring the output of the power system 140. In this regard, the sensor 162 comprises any suitable sensor which can measure an output of the power system 140. The control circuitry 160 has a sensor 164 for measuring an electrical property of the heating system 120. In this regard, the sensor 164 comprises any suitable sensor which can measure an electrical property which varies with temperature of the heating system 120. In the described implementation, the sensor 162 is a voltage sensor 162 for measuring a voltage supplied by the power system 140, and the sensor 164 is a resistance sensor 164 for measuring a resistance of the heating system 120.

In the described embodiment, the control circuitry 160 controls the heating profile provided by the heating system 120 based on the measurements from the voltage sensor 162 and the resistance sensor 164. The voltage sensor 162 and resistance sensor 164 are arranged to take measurements during periods of non-smoking (e.g., the voltage sensor 162 and resistance sensor 164 may be controlled by control circuitry 160 to take measurements during periods of non-smoking, or alternatively, the control circuitry 160 may be arranged to receive and/or process measurements from the voltage sensor 162 and resistance sensor 164 during periods of non-smoking).

A period of non-smoking is a period wherein the system is not being used to produce an inhalable vapor or aerosol, in a broad sense. Such periods may be seen as inactive periods, as they are periods during which the user is not actively interacting with the system. "Non-smoking" does not refer strictly to smoke, but the use of the system to provide an inhalable vapor or aerosol.

In the example shown in FIG. 1, the system 100 has a body 102 and an outlet 104. The components of the system 100 are contained within the body 102. Prior to use, an aerosol generating medium 180 may be provided or supplied to the system 100. The aerosol generating medium 180 is shown in FIG. 1 as being arranged towards the heating system 120. The outlet 104 is arranged to allow aerosol to pass from the aerosol generating medium 180 to the outside of the system 100, for inhalation by a user.

The heating system 120 may in an example comprise a resistive heater, through which a current may be sent so as to generate heat with which to produce an aerosol from an aerosol generating medium proximate to the heating system 120. The resistive heater is an example of a heating element. The heating system 120 may contain a wick or the like for use with an aerosol generating medium 180 which may be in a liquid form. The wick or the like may transport the aerosol generating medium 180 from a bulk storage area (e.g., a reservoir) to the heating system 120. In some examples, the wick may be formed of a cotton or other fibrous media. The heating system 120 may be part of a cartomizer or the like.

The heating system 120 is connected to the control circuitry 160. The resistance sensor 164 is arranged to take measurements of the resistance of the heating system 120. The resistance of the heating system 120 may vary based on conditions relating to aerosol production. In an example, the power expended for the puff (user inhalation) prior to the measurement may be detectable by virtue of the resistance of the heating system 120 immediately after the puff. The resistance of the heating system 120 may also be informative as to the amount of aerosol generating medium 180 proximate the heating element of the heating system 120. The resistance of the heating system 120 may also be informative as to the temperature of the heating system 120, and this can be used to control the power delivery to the heating system 120.

As such, the control circuitry 160 may use measurements of the resistance of the heating system 120 to make a determination as to when there is a higher than usual chance of dry out. Therefore, in preparing the heating profile for the subsequent puffs, the control circuitry 160 may take into account the resistance of the heating system 120 and thereby avoid providing a power or temperature profile which might overheat the heating system 120 or dry out and/or burn or damage any part of the heating system 120 (e.g. a wick).

The power system 140 may have a battery or the like for providing power within the aerosol provision system 100. The power system 140 may have any source of energy which may be converted into electrical energy for use within the aerosol provision system 100. The power system 140 is electrically connected to the control circuitry 160. The control circuitry 160 controls the delivery of the energy from the power system 140 to the heating system 120. The voltage sensor 162 of the control circuitry 160 is arranged to measure a voltage of the power system 140. This measurement may be used by the control circuitry 160 to provide an indication of the remaining energy within the power system 140. Subsequent heating profiles may be designed by the control circuitry based on the remaining energy within the power system 140. This can allow for the power remaining in the system 100 to be suitably apportioned across a number of subsequent uses. Furthermore, previous fluctuations in power delivery may be accommodated via lower power delivery in subsequent uses. This allows for provision of a system which is therefore able to react to previous power usage when designing subsequent heating profiles for subsequent puffs.

The control circuitry 160 may take measurements on power system 140 and heating system 120 via the voltage sensor 162 and the resistance sensor 164 to perform power control. The control circuitry 160 takes measurements during periods of non-smoking. When performing power control (through voltage measurements and resistance detection), the system 100 may need to deliver a larger power than that for normal usage to the heating system 120 in a short period of time and this may generate a higher heat at a heating element within the heating system 120 than that during normal usage. This high heating level may generate a higher level of aerosol and/or undesirable particles which might provide an unpleasant taste to the user if inhaled. When performing these measurements during a puff, particularly with puff activation, the user may inhale these undesirable particles. This may be mitigated by taking the measurements during periods of non-smoking. Therefore, the user experience of the system 100 is improved. In some implementations, the particles may be removed from the device via passive processes such as diffusion or actively via a fan or the like. In some instances, the generated particles may condense on surfaces within the device and subsequently run to designated liquid collection areas within the device or out through holes/openings, such as opening 104, in the device.

The system 100 may have a puff sensor or the like, which is part of, or connected to, the control circuitry 160. This allows the control circuitry 160 to sense when the system 100 is, and is not, in use. This assists the control circuitry 160 in scheduling measurements from the voltage sensor 162 and/or the resistance sensor 164 in periods of non-use. The control circuitry 160 may also control delivery of the power from the power source 140 during periods of use. As such, the control circuitry 160 is able to schedule measurements to occur in periods of non-use as this corresponds to periods wherein the control circuitry 160 is not delivering power to the heating system 120 to generate an aerosol.

The system 100 may be user activated, in the manner of a push button on the body 102 of the device 100 or the like. This may provide a signal to the control circuitry 160 as to when the device is, and is not, in use and therefore when to schedule measurements of at least one of voltage and resistance.

The control circuitry 160 may provide a first heating profile for a first puff, then take measurements of the voltage and resistance ahead of a second puff and then provide a second heating profile for a second puff. The first heating profile and the second heating profile may be different. The system 100 is therefore able to react to changes in the power delivery of the system 100 and in the heating system 120, and provide a suitable aerosol over a number of uses of the system 100.

That the measurements after one puff are used in the delivering of power for a subsequent puff means the system 100 is able to account for the condition of the system 100 immediately prior to the puff to be taken. This enables the control circuitry 160 to account for fluctuations in the power delivery and amount of aerosol generating medium 180 accurately to provide a highly suitable heating profile which in turn leads to an improved user experience. The control circuitry 160 may design the heating profile for the subsequent puff taking account of measurements of voltage and resistance.

The power delivered by the power system 140 may be delivered via at least one of pulse-width modulation (PWM), pulse-density modulation (PDM), pulse-frequency modulation (PFM), and DC to DC voltage conversion. In principle, any technique and associated circuitry which can deliver controlled voltage/power to the heating system 120 can be used in accordance with the principles of the present disclosure.

Figure 2:
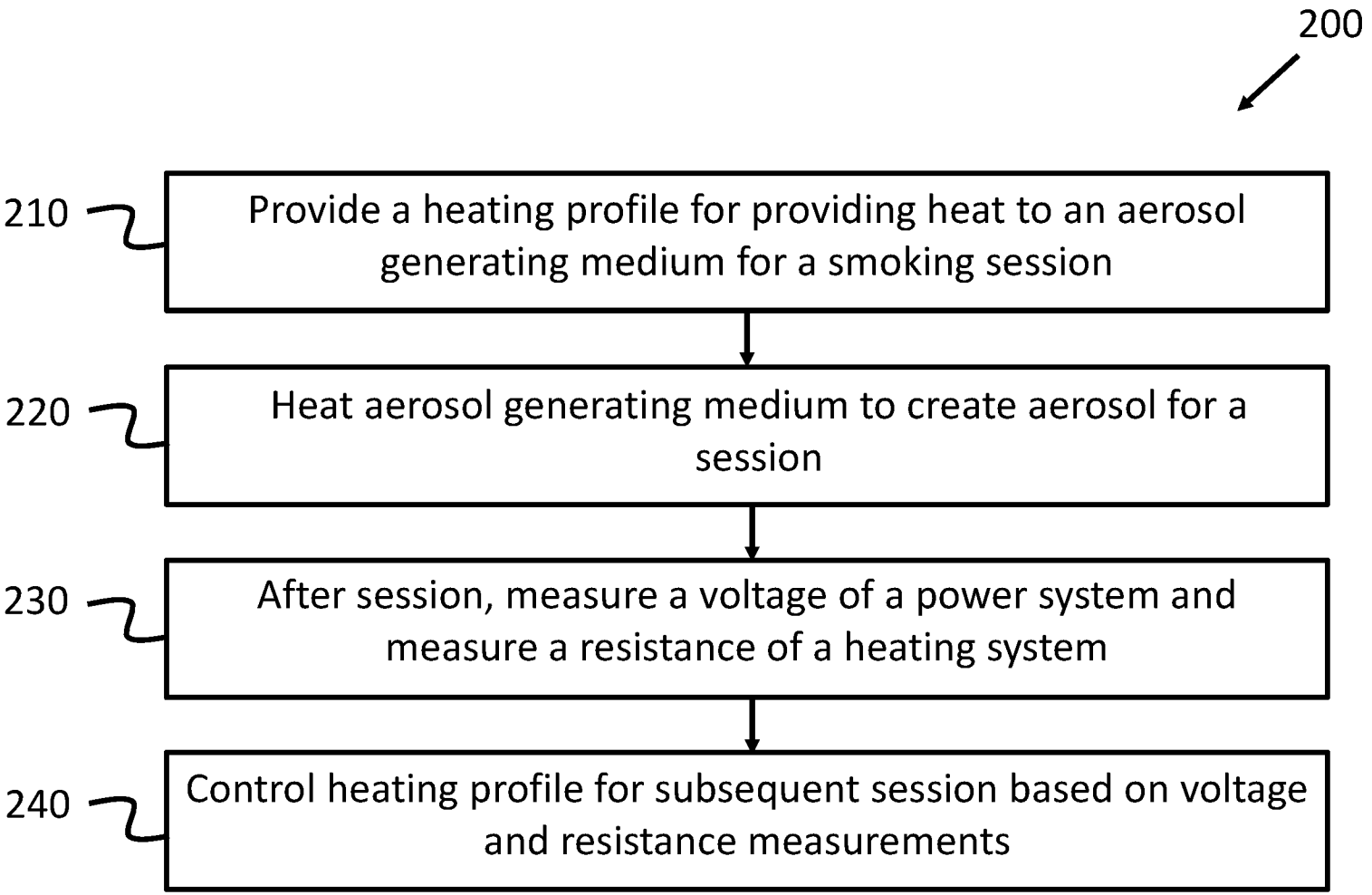
FIG. 2 is a flowchart of a method of providing an aerosol from an aerosol provision system according to an example; and, FIG. 3 is a flowchart of a method of providing an aerosol from an aerosol provision system according to an example.

Turning to the example of FIG. 2, a flowchart 200 of a method of providing an aerosol from an aerosol provision system is shown. The flowchart 200 shows a method which, in this specific example, has four steps 210, 220, 230, 240.

The first step 210 of the method is to provide a heating profile for providing heat to an aerosol generating medium for a puff. This heating profile may be provided by a combination of a power system 140 and control circuitry 160 as shown in FIG. 1 of the aerosol provision system 100.

The second step 220 of the method is to heat aerosol generating medium to create an aerosol for the puff. This heating may be provided by a combination of the heating system 120, the power system 140 and control circuitry 160 as shown in FIG. 1 of the aerosol provision system 100. The heating may be provided via any of PWM, PDM, PFM, and DC to DC voltage conversion, as described above.

The third step 230 of the method is to, after the session or puff has ceased, measure a voltage of the power system 140 and measure a resistance of the heating system 120. Measuring at this point in the use cycle of a system 100, as noted above, has a beneficial impact on the inhalation of particles of a user during smoking sessions. These measurements are made by the voltage sensor 162 and the resistance sensor 164 of the control circuitry 160 as shown in FIG. 1.

The fourth step 240 of the method is to control a heating profile for a subsequent session based on the voltage and resistance measurements prior to it. The voltage and resistance measurements are those taken in step 230. This step allows the control circuitry 160 to amend the heating profile of the next puff as a result of the usage of resources (power and aerosol generating medium 180) from the previous puff. This provides a reactive heating profile which operates to protect the system 100 from overheating, burning a wick (if present in the system 100) and against depletion of aerosol generating medium 180.

The method may comprise a step wherein the control circuitry 160 designs the heating profile for use in the subsequent puff. In this stage, factors such as maximum temperature of heating, duration of heating, power modulation type, rate of heating, etc. as provided by the heating system 120 may be selected and combined for the heating profile to be delivered. The designing of the heating profile may be impacted by the measurements taken by the voltage sensor 162 and the resistance sensor 164.

Figure 3:
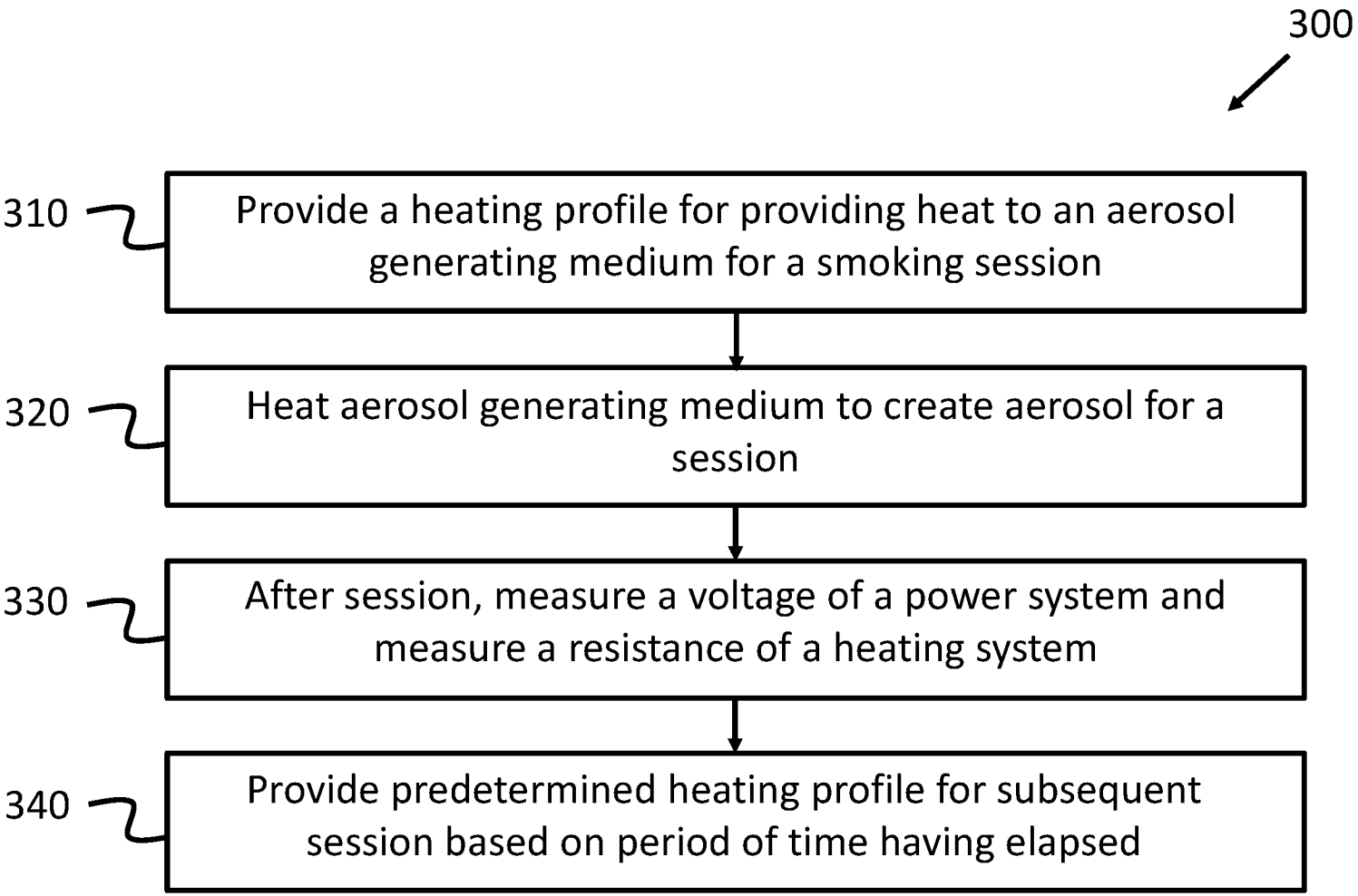

Turning to the example of FIG. 3, a flowchart 300 of a method of providing an aerosol from an aerosol provision system is shown. The flowchart 300 shows a method which, in this specific example, has four steps 310, 320, 330, 340. The method of FIG. 3 has a number of steps in common with FIG. 2. For efficiency, these steps will not be discussed in detail here. These are the first three steps 310, 320, 330. These refer to the provision of a heating profile (step 310), heating an aerosol generating medium to produce an aerosol (step 320) and measuring a voltage of a power system and a resistance of a heating system (step 330).

The fourth step 340 of the method is to provide a predetermined heating profile for a subsequent session or a subsequent puff based on a period of time having elapsed between the previous session or puff and the subsequent session or puff. The period of time is predetermined and may be programmed into the control circuitry 160 at manufacture or during use of a user.

In the example shown in FIG. 3, the system 100 is used by a user for a first puff. After the cessation of the first puff, the control circuitry 160 controls measurements of the voltage and resistance as described above and may design a heating profile based on these measurements. The system 100 may then not be used for an extended period of time by the user. In an example, the last usage on one day may be followed by an extended period of non-use of the system 100 prior to the first usage on the subsequent day (i.e. an overnight period). In this example, the control circuitry 160 instead programs a default heating profile for the next usage, once a predetermined period of time has elapsed.

The system 100 may, for example, have been refilled (or topped up) with aerosol generating medium or the power system recharged during in this period of time and, as such, the measurements previously taken may no longer be relevant to the resources present in the system 100.

In an example, the control circuitry 160 may design a heating profile for use ahead of the subsequent puff, but within the predetermined time period, and then revert to a default heating profile after the predetermined time period has elapsed. This allows for no delay to occur from the control circuitry 160 designing the heating profile prior to the subsequent puff being taken by the user.

Alternatively, the control circuitry 160 may design and provide a heating profile as and when the subsequent puff occurs within the predetermined time period. This means the control circuitry 160 need not design a heating profile which may not be used, which might be the case if the period of time elapses after the heating profile has been designed but prior to the subsequent puff occurring.

The default heating profile may comprise a default power delivery scheme (PWM, PDM, or PFM, or DC to DC conversion), default pulse duty cycle, or pulse density, or pulse frequency, or output voltage. The default heating profile may have a default maximum temperature which is based on a low average of the temperatures used for the most common aerosol generating media. This low average results in a low risk of burning the heating system 120 or the aerosol generating medium 180 from use of the default heating profile. The default heating profile may be the same heating profile as is provided by the system 100 when the system 100 is used for the very first time.

In an example, the system 100 provides a heating profile for a first puff. The first puff concludes and measurements of voltage and resistance are made afterwards by control circuitry 160. The control circuitry 160 designs a second heating profile based on the measurements and a second puff occurs within the predetermined time period. The second heating profile is provided to the heating system 120 to deliver to the aerosol generating medium 180. The second puff concludes and new measurements of voltage and resistance are made. The control circuitry 160 designs a third heating profile based on the new measurements but a third puff does not occur within the predetermined time period. The default heating profile is therefore provided to the heating system 120 to deliver to the aerosol generating medium 180 once the third puff occurs.

The aerosol generating medium may comprise at least one of tobacco and glycol and may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. The different aerosol generating media may be separated, adjacent or overlapping.

Aerosolizable material, which also may be referred to herein as aerosol generating material (or medium), is material that is capable of generating aerosol, for example when heated, irradiated or energized in any other way. Aerosolizable material may, for example, be in the form of a solid, liquid or gel which may or may not contain nicotine and/or flavorants. The aerosol generating medium described herein may comprise an "amorphous solid", which may alternatively be referred to as a "monolithic solid" (i.e. non-fibrous), or as a "dried gel". The amorphous solid is a solid material that may retain some fluid, such as liquid, within it. In some cases, the aerosol generating medium comprises from about 50 wt %, 60 wt % or 70 wt % of amorphous solid, to about 90 wt %, 95 wt % or 100 wt % of amorphous solid. In some cases, the aerosol generating medium consists of amorphous solid.

The aerosol forming material may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

The aerosolizable material may comprise an active material, an aerosol forming material and optionally one or more functional materials.

The active material may comprise nicotine or one or more other non-olfactory physiologically active materials. A non-olfactory physiologically active material is a material which is included in the aerosolizable material in order to achieve a physiological response other than olfactory perception.

The one or more functional materials may comprise one or more of flavors, carriers, pH regulators, stabilizers, and/or antioxidants.

The aerosolizable material may be present on a substrate. The substrate may, for example, be or comprise paper, card, paperboard, cardboard, reconstituted aerosolizable material, a plastics material, a ceramic material, a composite material, glass, a metal, or a metal alloy.

Thus there has been described an aerosol provision system comprising: a heating system; a power system for providing power to the heating system; and, control circuitry for controlling a heating profile provided by the heating system, the control circuitry comprising: a voltage sensor, for measuring a voltage supplied by the power system; and, a resistance sensor, for measuring a resistance of the heating system, wherein the control circuitry controls the heating profile provided by the heating system based on measurements from the voltage sensor and the resistance sensor, and wherein the voltage sensor and resistance sensor are arranged to take measurements during periods of non-smoking.

The aerosol provision system may be used in a tobacco industry product, for example a non-combustible aerosol provision system.

In one embodiment, the tobacco industry product comprises one or more components of a non-combustible aerosol provision system, such as a heater and an aerosolizable substrate.

In one embodiment, the aerosol provision system is an electronic cigarette also known as a vaping device.

In one embodiment the electronic cigarette comprises a heater, a power supply capable of supplying power to the heater, an aerosolizable substrate such as a liquid or gel, a housing and optionally a mouthpiece.

In one embodiment the aerosolizable substrate is contained in or on a substrate container. In one embodiment the substrate container is combined with or comprises the heater.

In one embodiment, the tobacco industry product is a heating product which releases one or more compounds by heating, but not burning, a substrate material. The substrate material is an aerosolizable material which may be for example tobacco or other non-tobacco products, which may or may not contain nicotine. In one embodiment, the heating device product is a tobacco heating product.

In one embodiment, the heating product is an electronic device.

In one embodiment, the tobacco heating product comprises a heater, a power supply capable of supplying power to the heater, an aerosolizable substrate such as a solid or gel material.

In one embodiment the heating product is a non-electronic article.

In one embodiment the heating product comprises an aerosolizable substrate such as a solid or gel material, and a heat source which is capable of supplying heat energy to the aerosolizable substrate without any electronic means, such as by burning a combustion material, such as charcoal.

In one embodiment the heating product also comprises a filter capable of filtering the aerosol generated by heating the aerosolizable substrate.

In some embodiments the aerosolizable substrate material may comprise an aerosol or aerosol generating agent or a humectant, such as glycerol, propylene glycol, triacetin or diethylene glycol.

In one embodiment, the tobacco industry product is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment, the hybrid system comprises a liquid or gel substrate and tobacco.

In order to address various issues and advance the art, the entirety of this disclosure shows by way of illustration various embodiments in which the claimed invention(s) may be practiced and provide for a superior electronic aerosol provision system. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An aerosol provision system comprising:
- a heating system;
- a power system for providing power to the heating system; and,
- control circuitry for controlling a heating profile provided by the heating system during periods of smoking, the control circuitry comprising:
  - a first sensor, for measuring an output of the power system; and,
  - a second sensor, for measuring an electrical property of the heating system,
- wherein the control circuitry controls the heating profile provided by the heating system during periods of smoking based on measurements from the first sensor and the second sensor taken during periods of non-smoking.

2. An aerosol provision system according to claim 1, wherein the control circuitry is arranged to control delivery of power from the power system to the heating system, and
- wherein the control circuitry is arranged to obtain the voltage of the power system and the resistance of the heating system from during periods of non-delivery of power to the heating system.

3. An aerosol provision system according to claim 1, wherein the power system is arranged to deliver power via at least one of:
- pulse-width modulation;
- pulse-density modulation;
- pulse-frequency modulation; and,
- DC to DC voltage conversion.

4. An aerosol provision system according to claim 1, wherein the system is arranged to provide:
- a first heating profile for a first puff; and,
- a second heating profile for a second puff, wherein
- the first heating profile and the second heating profile are different.

5. An aerosol provision system according to claim 4, wherein the second heating profile is controlled by the control circuitry,
- and wherein the second heating profile is designed based on the measurements from the first sensor and the second sensor.

6. An aerosol provision system according to claim 4, wherein the second heating profile is a predetermined heating profile comprising a default setting of duty cycle or pulse density, or pulse frequency, or output voltage.

7. An aerosol provision system according to claim 6, wherein the control circuitry is arranged to provide the predetermined heating profile for the second heating profile after a predetermined period of time has elapsed between the first puff and the second puff.

8. An aerosol provision system according to claim 1, wherein the system is arranged to provide:
- a first heating profile for a first puff; and,
- a second heating profile for a second puff, wherein the second heating profile is controlled by the control circuitry and wherein the second heating profile is designed based on the measurements from the first sensor and the second sensor taken during periods of non-smoking after the first puff.

9. An aerosol provision system according to claim 1, wherein the first sensor is a voltage sensor for measuring a voltage supplied by the power system, and the second sensor is a resistance sensor for measuring a resistance of the heating system.

10. A method of providing an aerosol in an aerosol provision device, the method comprising:
- providing a heating system;
- providing a power system for providing power to the heating system;
- providing control circuitry for controlling a heating profile provided by the heating system during periods of smoking;
- providing a first heating profile for a first puff;
- measuring at least one of an output of the power system and an electrical property of the heating system after the first puff during periods of non-smoking; and,
- providing a second heating profile for a second puff based on the measurements taken during periods of non-smoking.

11. A method according to claim 10, further comprising:
- designing the second heating profile based on measuring at least one of:
- the voltage of the power system; and,
- the resistance of the heating system.

12. A method according claim 11, further comprising:
- providing the second heating profile for the second puff based on a predetermined period of time having not elapsed between the first puff and the second puff.

13. A method according to claim 10, wherein the second heating profile is a predetermined heating profile comprising a default setting of duty cycle, or pulse density, or pulse frequency, or output voltage.

14. A method according to claim 13, comprising:

providing the predetermined heating profile for the second puff based on a predetermined period of time having elapsed between the first puff and the second puff.

15. Control circuitry for an aerosol provision system comprising:

a first sensor, for measuring an output of a power system of the aerosol provision system; and, a second sensor, for measuring an electrical property of a heating system of the aerosol provision system, wherein the control circuitry controls a heating profile provided by the heating system during periods of smoking based on measurements from the first sensor and the second sensor, and wherein the first sensor and second sensor are arranged to take measurements during periods of non-smoking of the aerosol provision system.

16. Control circuitry according to claim 15, wherein the control unit is arranged to:

design a heating profile for a second puff based on measurements of the voltage of the power system and the resistance of the heating system taken after a first puff.

17. Aerosol provision means comprising:

heating means;

power means for providing power to the heating means; and, control means for controlling a heating profile provided by the heating means during periods of smoking, the control means comprising:

first sensing means, for measuring an output of the power means; and, second sensing means, for measuring an electrical property of the heating means, wherein the control means controls the heating profile provided by the heating means during periods of smoking based on measurements from the first sensing means and the second sensing means, and wherein the first sensing means and second sensing means are arranged to take measurements during periods of non-smoking.

* * * * *